US011408101B2

(12) United States Patent
Tassell

(10) Patent No.: US 11,408,101 B2
(45) Date of Patent: Aug. 9, 2022

(54) CONTINUOUS STRAND WEAVING HEXAGON PIN LOOMS AND METHODS OF USE

(71) Applicant: BLUEBONNET CRAFTERS, LLC, San Marcos, TX (US)

(72) Inventor: Gabriele Van Tassell, San Marcos, TX (US)

( * ) Notice: Subject to any disclaimer, the term of this patent is extended or adjusted under 35 U.S.C. 154(b) by 703 days.

(21) Appl. No.: 16/247,471

(22) Filed: Jan. 14, 2019

(65) Prior Publication Data

US 2019/0218693 A1 Jul. 18, 2019

Related U.S. Application Data

(60) Provisional application No. 62/617,249, filed on Jan. 14, 2018.

(51) Int. Cl.
*D03D 29/00* (2006.01)
*D03D 3/06* (2006.01)
(Continued)

(52) U.S. Cl.
CPC ..... *D03D 29/00* (2013.01); *D03D 3/06* (2013.01); *D03D 13/002* (2013.01); *D03D 13/004* (2013.01); *D03D 33/00* (2013.01)

(58) Field of Classification Search
CPC ..... D03D 29/00; D03D 33/00
(Continued)

(56) References Cited

U.S. PATENT DOCUMENTS 2,159,264 A * 5/1939 Annie ..... D03D 29/00 139/383 R
2,159,265 A * 5/1939 Annie ..... D03D 29/00 139/34

(Continued)

FOREIGN PATENT DOCUMENTS

CN 202744723 U * 2/2013
JP 62263346 A * 11/1987

OTHER PUBLICATIONS

Ackwood, Jennifer, director. Hexagon Loom Tutorial. YouTube, YouTube, Aug. 9, 2017, www.youtube.com/watch?v=PnoEH_k3aEw . (Year: 2017).*

(Continued)

*Primary Examiner* — Khoa D Huynh
*Assistant Examiner* — Grace Huang
(74) *Attorney, Agent, or Firm* — Hulsey P.C.

(57) ABSTRACT

A method and system for forming a hexagonal woven fabric provide a hexagonal pattern loom including loom pins arranged in a hexagonal pattern to form a structure for engaging a continuous yarn strand. The loom pins form a top angled side of the hexagonal pattern and a bottom angled side of the hexagonal pattern. A set of the loom pins form two opposite straight sides of the hexagonal pattern forming the hexagonal pattern loom. A bias weaving process uses the continuous yarn strand for forming a top woven triangle fabric section, a bottom woven triangle fabric section, and a middle section of parallel yarn strand portions of the single continuous yarn strand. Traditional back-and-forth weaving uses the continuous yarn strand as weft strands in the middle section of parallel yarn strand portions for forming a rectangular woven fabric section. A hexagonal woven fabric uses the continuous yarn strand.

6 Claims, 15 Drawing Sheets

(51) Int. Cl.
*D03D 13/00* (2006.01)
*D03D 33/00* (2006.01)

(58) Field of Classification Search
USPC ..... 139/29
See application file for complete search history.

(56) References Cited

U.S. PATENT DOCUMENTS 2,186,692 A * 1/1940 Boyer ..... D03D 29/00 139/34
2,433,307 A * 12/1947 John ..... D03D 29/00 28/152
2,780,854 A * 2/1957 Dritz ..... D03D 29/00 139/34
3,347,281 A * 10/1967 Stars ..... D03D 29/00 139/29
3,748,706 A * 7/1973 Doyel ..... D03D 29/00 28/150
3,966,207 A * 6/1976 Pass ..... A63B 60/00 473/541
4,023,245 A * 5/1977 Zaltzman ..... D03D 29/00 28/152
4,041,585 A * 8/1977 Berger ..... D03D 29/00 28/149
4,044,437 A * 8/1977 Ebenstein ..... D03D 29/00 28/151
5,435,048 A * 7/1995 Walker ..... D03D 29/00 38/102.91
8,141,395 B2 * 3/2012 Dillavou ..... D04B 7/08 66/171
9,695,527 B1 * 7/2017 Clement ..... D03D 29/00
9,695,530 B2 * 7/2017 Hall ..... D03D 29/00
10,704,645 B2 * 7/2020 Gao ..... F16G 1/10
2010/0275764 A1 * 11/2010 Egres, Jr. ..... D03D 15/267 89/36.02
2016/0249594 A1 * 9/2016 Gunnarsson ..... A01K 73/02 87/7
2017/0268139 A1 * 9/2017 Peerzada ..... D03D 13/002
2018/0085683 A1 * 3/2018 Urso ..... D03D 29/00
2018/0140085 A1 * 5/2018 Mills ..... A46B 15/0081

OTHER PUBLICATIONS

Bluebonnet Crafters, LLC, director. How to Weave a Hexagon on a Pin Loom (All-In-One Version). YouTube, YouTube, Apr. 19, 2017, www.youtube.com/watch?v=w2dBsmq0H7c. (Year: 2017).*

* cited by examiner

CONTINUOUS STRAND WEAVING HEXAGON PIN LOOMS AND METHODS OF USE

CROSS REFERENCE TO RELATED APPLICATIONS

This application claims benefit to the provisional applications No. 62/617,249, entitled "Continuous Strand Weaving Hexagon Pin Looms and Methods of Use" filed on Jan. 14, 2018, naming inventor Gabriele van Tassell of San Marcos, Tex., and originally assigned to Bluebonnet Crafters, LLC, also of San Marcos, Tex.

FIELD OF THE INVENTION

The present disclosure relates to continuous strand weaving hexagon pin looms and methods of use.

BACKGROUND

Weaving is a method of textile production in which two distinct sets of yarns or threads are interlaced at right angles to form a fabric or cloth. Other methods are knitting, crocheting, felting, and braiding or plaiting. The longitudinal threads are called the warp and the lateral threads are the weft or filling. Weft is an old English word meaning "that which is woven." The method in which these threads are inter-woven affects the characteristics of the cloth. Cloth is usually woven on a loom, a device that holds the warp threads in place while filling threads are woven through them. A fabric band which meets this definition of cloth (warp threads with a weft thread winding between) can also be made using other methods, including tablet weaving, back strap loom, or other techniques without looms.

The way the warp and filling threads interlace with each other is called the weave. Woven cloth can be plain (in one color or a simple pattern) or can be woven in decorative or artistic design.

In general, weaving involves using a loom to interlace two sets of threads at right angles to each other: the warp which runs longitudinally and the weft that crosses it. One warp thread is called an end and one weft thread is called a pick. The warp threads are held taut and in parallel to each other, typically in a loom.

Although weaving is an ancient craft, there are needs for improvements and innovations in the manufacture and use of looms for weaving and processes for using them. These needs give rise to invention to address new solutions.

SUMMARY OF THE DISCLOSURE

In light of the above problems, the disclosed subject matter includes method and system for continuous strand weaving hexagon pin looms and methods of use.

According to one aspect, the disclosed subject matter provides a method for forming a hexagonal woven fabric, comprising the steps of providing a single continuous yarn strand for forming the hexagonal woven fabric. The method and system using such method provide a hexagonal pattern loom. The loom includes a plurality of loom pins perpendicularly embedded into the loom frame and a protruding predetermined distance for engaging and holding the single continuous yarn strand. The loom pins are arranged in a hexagonal pattern to form a structure for engaging continuous yarn strand. A first predetermined subset of the loom pins form a top angled side of the hexagonal pattern. A second predetermined subset of the loom pins form a bottom angled side of the hexagonal pattern. A third predetermined subset of the loom pins form two opposite straight sides of the hexagonal pattern, the two opposite straight sides having a length essentially equal to and connected to the top angled side and the bottom angled side to form the pin spacing for the hexagonal pattern loom.

A bias weaving process uses the continuous yarn strand for forming a top woven triangle fabric section, a bottom woven triangle fabric section, and a middle section of parallel yarn strand portions of the single continuous yarn strand, the middle section form a plurality of weaving warps for continuing to weave using the single continuous yarn strand.

Traditional back-and-forth weaving uses the continuous yarn strand as weft strands in the middle section of parallel yarn strand portions for forming a rectangular woven fabric section. Upon completing the back-and-forth weaving step, the top woven triangle fabric section, bottom woven triangle fabric section, and said rectangular woven fabric section form a hexagonal woven fabric using the continuous yarn strand. The method and system further include the step of and means for separating said hexagonal woven fabric from said hexagonal pattern loom.

BRIEF DESCRIPTION OF THE DRAWINGS

The novel features believed characteristic of the disclosed subject matter are set forth in claims that are filed herewith. The disclosed subject matter itself, however, as well as the preferred mode of use, further objectives, and advantages thereof, will best be understood by reference to the following detailed description of an illustrative embodiment when read in conjunction with the accompany drawings, wherein:

DETAILED DESCRIPTION OF ILLUSTRATIVE EMBODIMENTS

One or more embodiments of the invention are described below. It should be noted that these and any other embodiments are exemplary and are intended to be illustrative of the invention rather than limiting. While the invention is widely applicable to different types of systems, it is impossible to include all the possible embodiments and contexts of the invention in this disclosure. Upon reading this disclosure, many alternative embodiments of the present invention will be apparent to persons of ordinary skill in the art.

The detailed description set forth below in connection with the appended drawings is intended as a description of exemplary embodiments in which the presently disclosed process can be practiced. The term "exemplary" used throughout this description means "serving as an example, instance, or illustration," and should not necessarily be construed as preferred or advantageous over other embodiments. The detailed description includes specific details for providing a thorough understanding of the presently disclosed method and system. However, it will be apparent to those skilled in the art that the presently disclosed process may be practiced without these specific details.

In the present specification, an embodiment showing a singular component should not be considered limiting. Rather, the subject matter preferably encompasses other embodiments including a plurality of the same component, and vice-versa, unless explicitly stated otherwise herein. Moreover, applicants do not intend for any term in the specification or claims to be ascribed an uncommon or special meaning unless explicitly set forth as such. Further, the present subject matter encompasses present and future known equivalents to the known components referred to herein by way of illustration.

Figure 1:
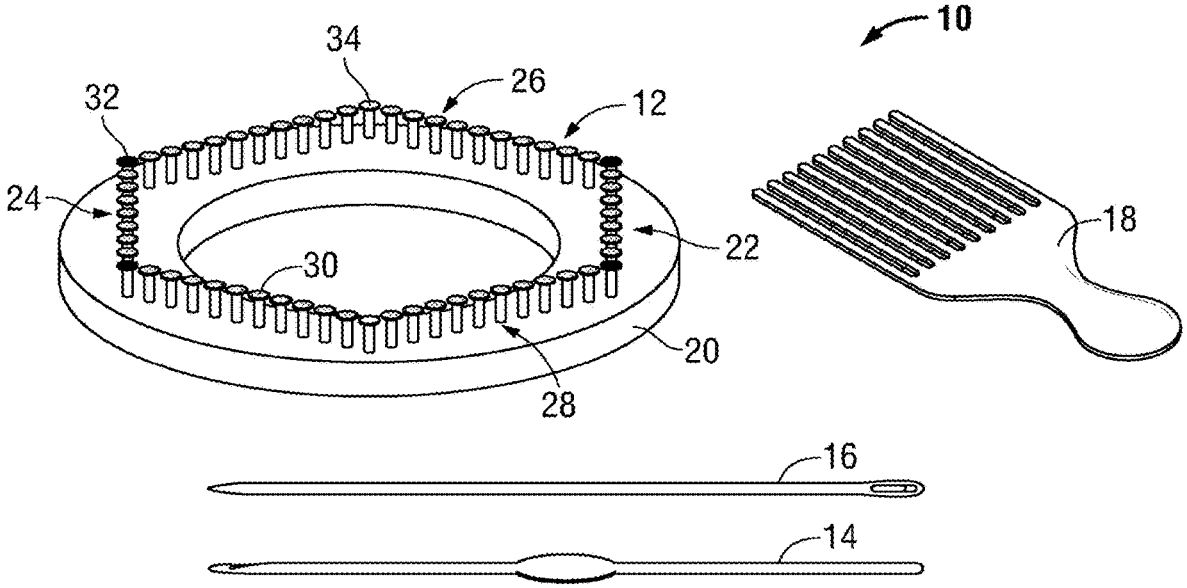
FIG. 1 shows the components of a kit including the continuous strand weaving pin loom of the present disclosure.

FIG. 1 shows continuous strand weaving pin loom or "turtle" loom kit 10 of the present disclosure. Turtle loom kit 10 includes turtle loom 12, crochet hook 14, weaving needle 16 and packing comb 18. Turtle loom 12 includes a hexagonal arrangement of pins vertically positioned in frame 20 on surface 22 in a predetermined arrangement. The spacing for each of the pins 20 depends on whether the pin is on a side position such as pins 24 or an angle side such as pins 26 and 28. Crochet hook 14 permits manipulation of strands from which turtle loom 12 will construct the hexagon woven fabric is here described.

In addition to the tools that come with the kit, there is the need for the user to have yarn from which to make the hexagon woven fabric. In general, any worsted weight yarn may be used (for the standard spaced looms). There is a broad spectrum of yarns that can be used with the presently disclosed loom.

Pins on the turtle loom 12 have different colors. Colored or brown pins 30, black pins 32, and white pins 34 have the same size and form integral pieces of hexagon loom pin arrangement 36. The upper and lower white pins 34 provide the connection for starting the hexagon weaving process. In addition, the turtle loom includes four black pins 32. The four black pins 32 are positioned at the other four corners not occupied by the two white pins. The four black pins 32 provide the position at which the hexagon weaving process shifts from bias weaving to traditional weaving, as further described below, in completing the hexagon woven fabric of the present disclosure. The black pins 32 and white pins 34 may be replaced by other means to indicate the location of these pins (for example, carved "x" and "o" or rings/lines near or around those pins), to guide the user in the weaving process. In such case, all of hexagon loom pin arrangement 36 may have the same color pins.

Figure 2:
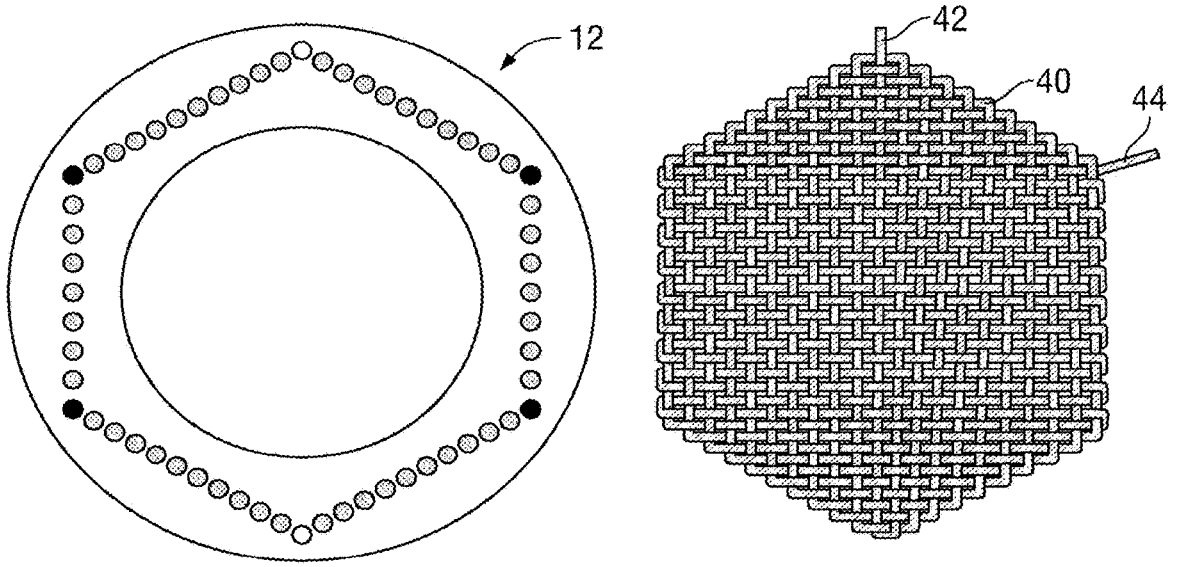
FIG. 2 illustrates a medium sized continuous strand weaving pin loom according to the present disclosure and the hexagon weave pattern resulting from use of loom.

FIG. 2 illustrates a medium-sized continuous strand weaving pin loom according to the present disclosure and the hexagon weave pattern resulting from use of loom. FIG. 2 shows hexagon woven fabric 40. Connecting to hexagonal woven fabric 40 are warp yarn strand 42 and weft yarn strand 44. By providing different pin spacing at different portions of the hexagon loom pin arrangement 36 and combining the two different weaving methods, a symmetrical hexagonal pattern results (i.e., equally evenly distributed woven pattern). The goal of creating the hexagons is to create a fabric where the strands that go horizontally and vertically are evenly spread out.

The two weaving methods are performed at different times in the weaving process and the pins are spaced so as to support the use of the two different weaving methods. This first method is sometimes referred to as "bias" weaving. The bias weaving method is used to create a top woven fabric triangle, a bottom woven fabric triangle, and vertical threads in the within the hexagon loom pin arrangements 36 which will serve as the warps for the traditional weaving described below. The vertical warps are formed, the upper and lower triangles are formed in the hexagon pattern.

Once the triangles are formed, the method changes to the "traditional" weaving method. The traditional weaving method employs weaving back-and-forth over the warps. And in so doing a weaving needle 16 goes under and over the threads that were formed in the bias weaving method. Thus, the warps are the vertical threads in the pattern and provide the structure through which the weft thread may be woven over and under across the warps to create the center part of the hexagon pattern.

Figure 3A:
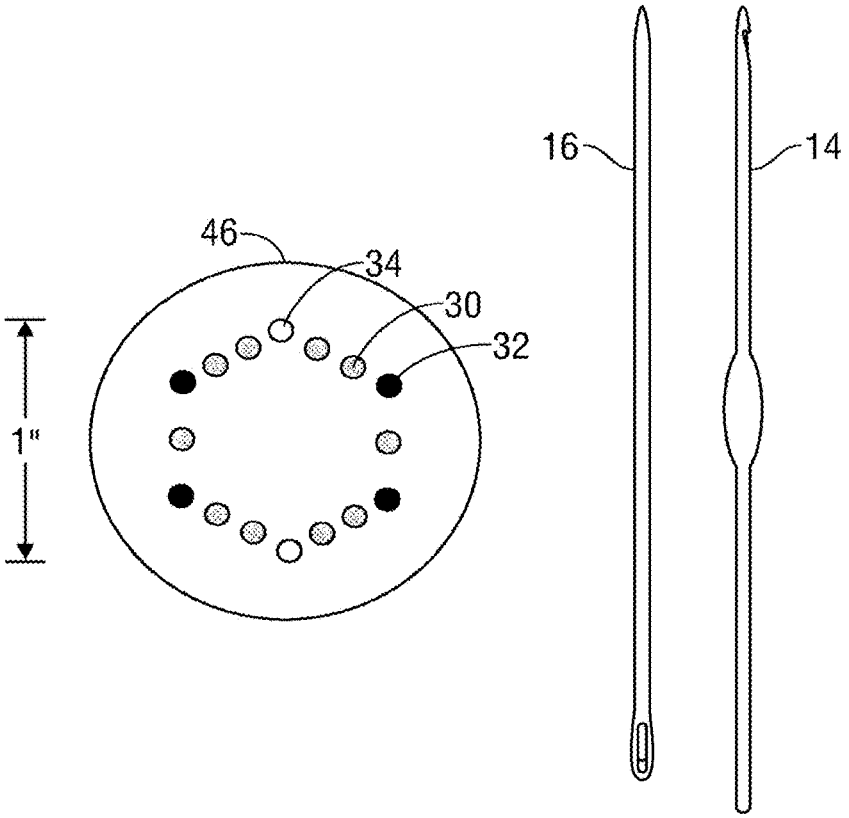
FIGS. 3A and 3B illustrate small-sized embodiments of the continuous strand weaving pin loom according to the teachings of the present disclosure, including a 1" loom (FIG. 3A) and a 2" loom (FIG. 3B)
Figure 3B:
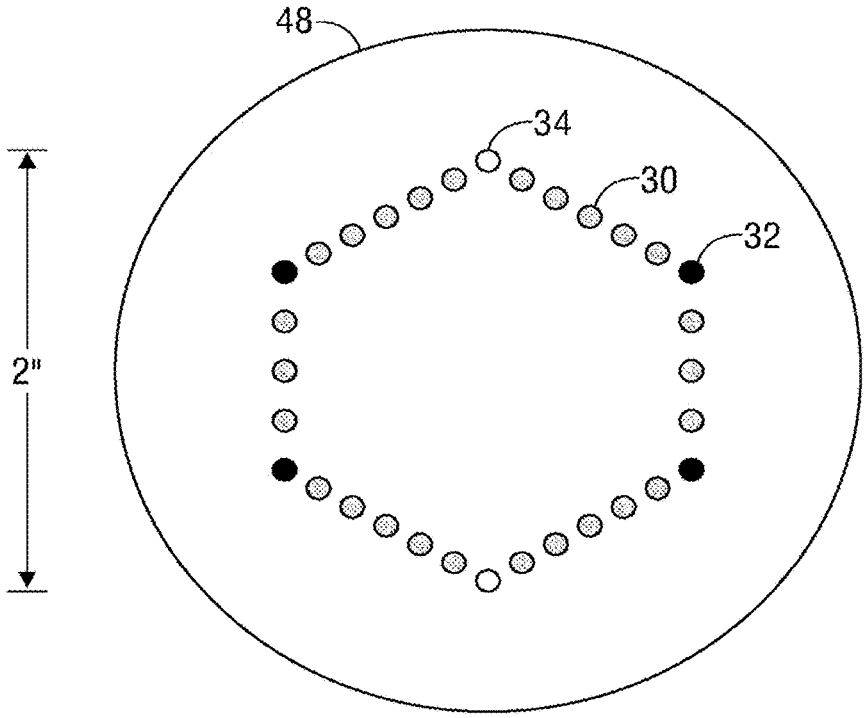
Figure 4:
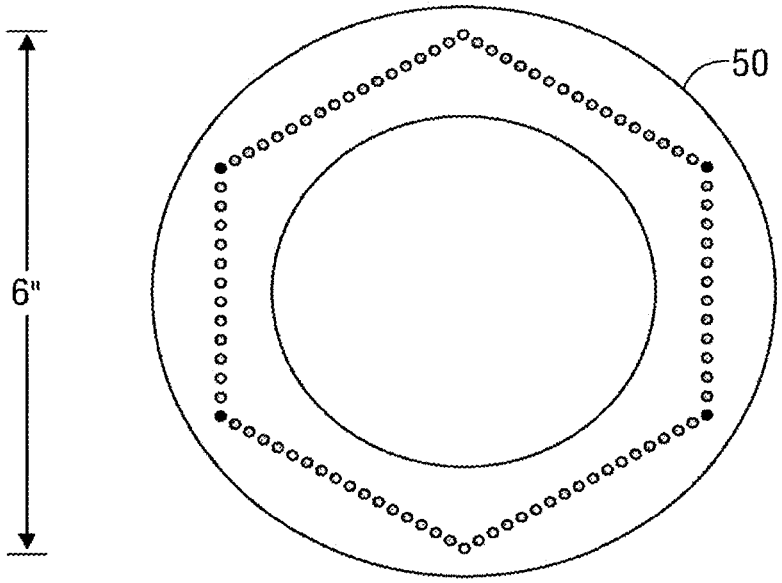
FIG. 4 shows a large embodiment (6" diameter) of the continuous strand weaving pin loom of the present disclosure.

Loom frame 20 may measure various sizes. This may include a much smaller or a much larger arrangement from which hexagons of smaller and larger sizes, respectively, may be formed. FIGS. 3A and 3B illustrate small-sized embodiments of the continuous strand weaving pin loom according to the teachings of the present disclosure, including a 1" loom 46 (FIG. 3A) and a 2" loom 48 (FIG. 3B). FIG. 4 illustrates a significantly larger turtle loom 50 for forming larger hexagonal patches than either turtle loom 46 or 48. Larger turtle loom 50 has a diameter of 6" and PRESENTLY SELLS UNDER THE BRAND "TexaTURTLE™" HEXAGON PIN LOOM KIT BY BLUEBONNET Crafters of San Marcos, Tex., the applicant hereof.

Figure 5A:
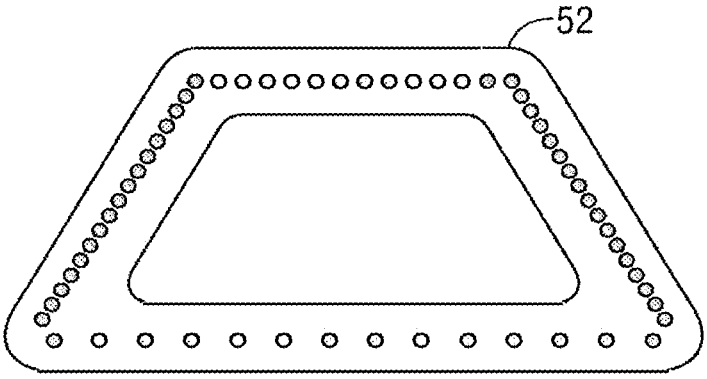
FIGS. 5A and 5B depict alternative embodiments of half-hexagon continuous strand weaving pin looms within the scope of the present disclosure.
Figure 5B:
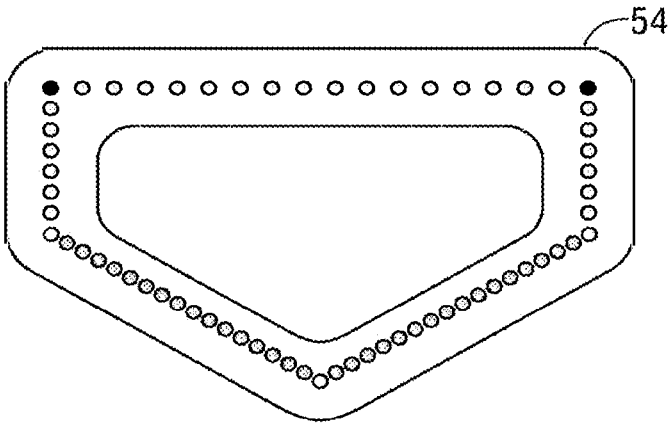

FIGS. 5A and 5B depict alternative embodiments of half-hexagon continuous strand weaving pin looms within the scope of the present disclosure. In both of these half hexagon looms, differently spaced pins provide the evenly spaced weave for forming a half hexagon woven fabric. By nature, hexagons have two different ways to cut them in half. Each of the half hexagons depend on the symmetrical aspects of the hexagon. The angle half hexagon pin loom 52 depends on the symmetry across the angles of a hexagon. Side half hexagon loom 54 depends on the symmetry across the sides of the hexagon.

Figure 6:
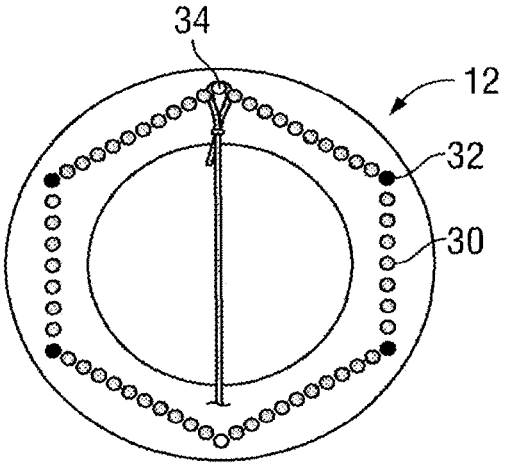
FIGS. 6 through 22 depict various aspects of methods for using the present fully disclosed continuous strand weaving pin looms.
Figure 7:
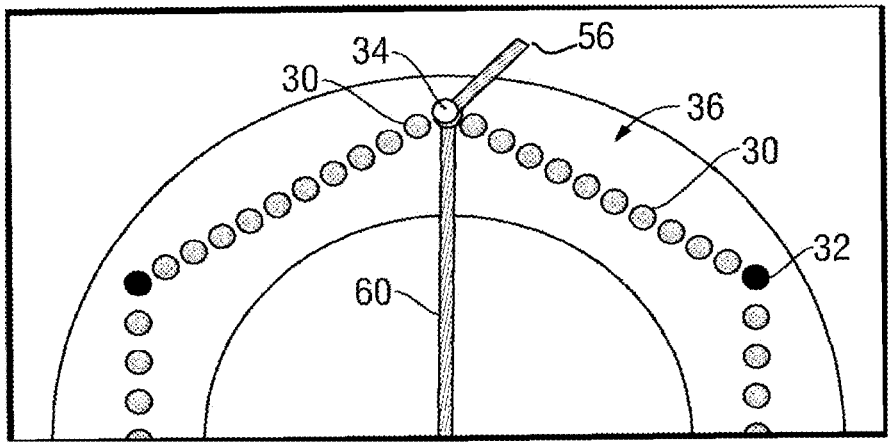

FIGS. 6 through 22 depict various aspects of methods for using the present fully disclosed continuous strand weaving pin looms. FIG. 6 shows the initial steps in the sequence of the weaving process. The weaving process begins with forming on continuous yarn strand a slip knot. FIG. 7 shows the loop of yarn strand 56 over top white pin 34, considered the starting pin. White pins 34 help the weaver get started in the bias weaving process. Yarn strand 56 is pulled down to become warp strand 62.

Figure 8:
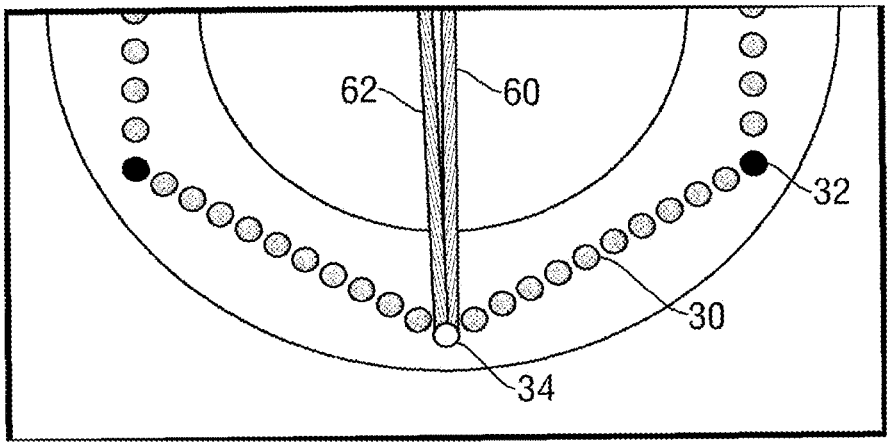
Figure 9:
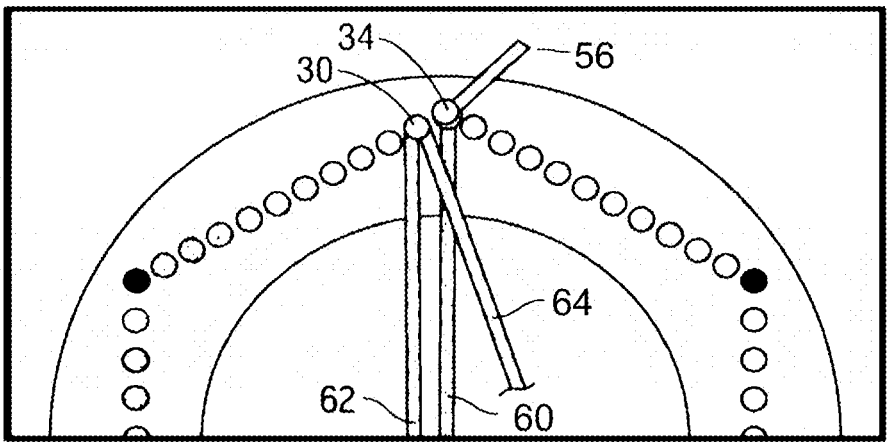
Figure 10:
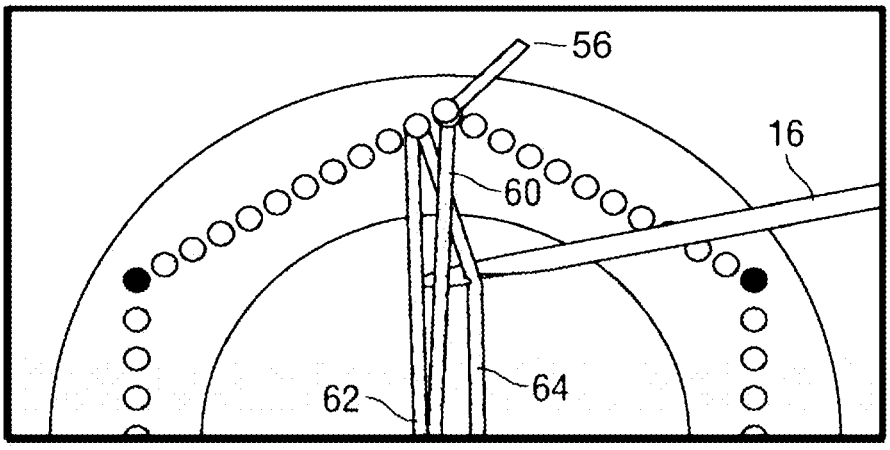
Figure 11:
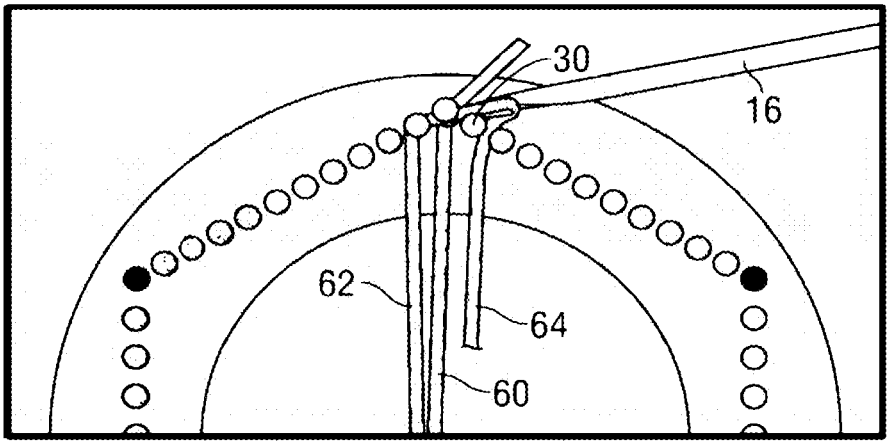
Figure 12:
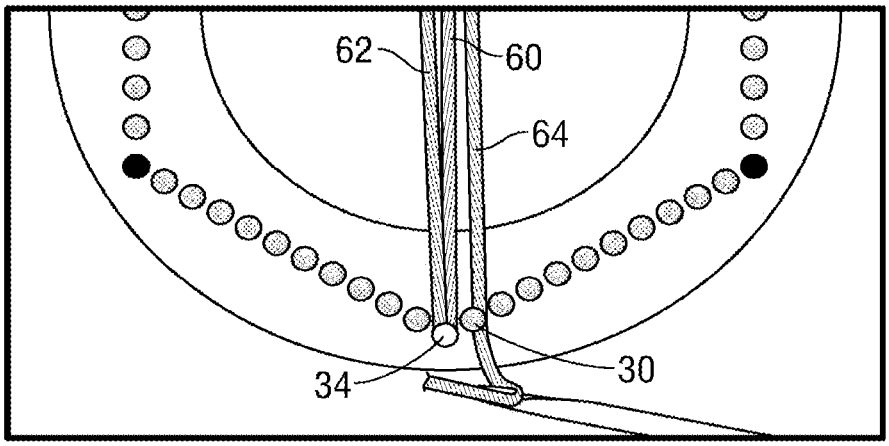
Figure 13:
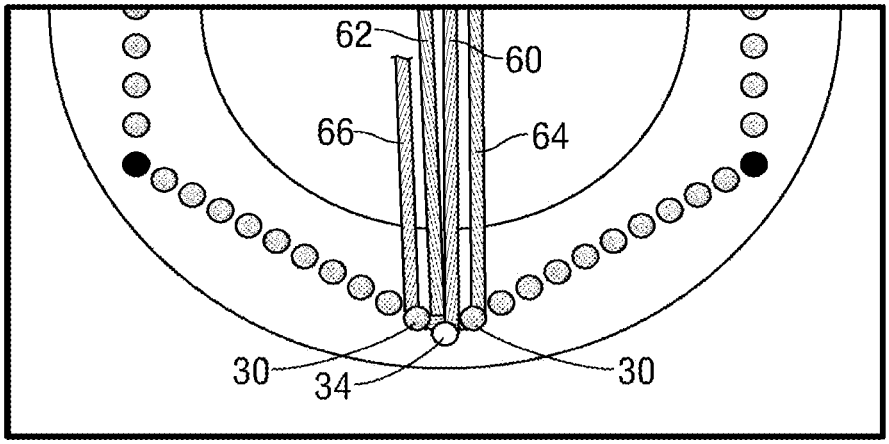

In FIG. 8 the weaver takes yarn strand 60 around the bottom white pin 34 from the right to the left and then back up forming warp strand 62. The weaving process continues in a clockwise fashion. In FIG. 9 the weaver returns to the top of loom 12, where warp strand 64 is to be threaded from the left to the right around the first brown pin 30 to the left of white pin 34 at the top angle of loom pin arrangement 36. FIG. 10 shows the weaver bringing warp strand 64 to be pulled under warp strand 62. FIG. 11 shows warp strand 64 is to be taken over first brown pin 30 to the right of white top starting pin 34. In FIG. 12, the workings of thread slides down to duplicate the weave down to the bottom triangle of the hexagon. In FIG. 12 warp strand 64 is guided around the first brown pin 30 to the right of bottom white pin 34. Warp strand 66 comes out to the left and weaves the first row of what will become the bottom triangle woven fabric segment. FIG. 13 shows this step of the process of taking warp strand 66 to the next brown pin 30 on the left side of bottom white pin 34.

Figure 14:
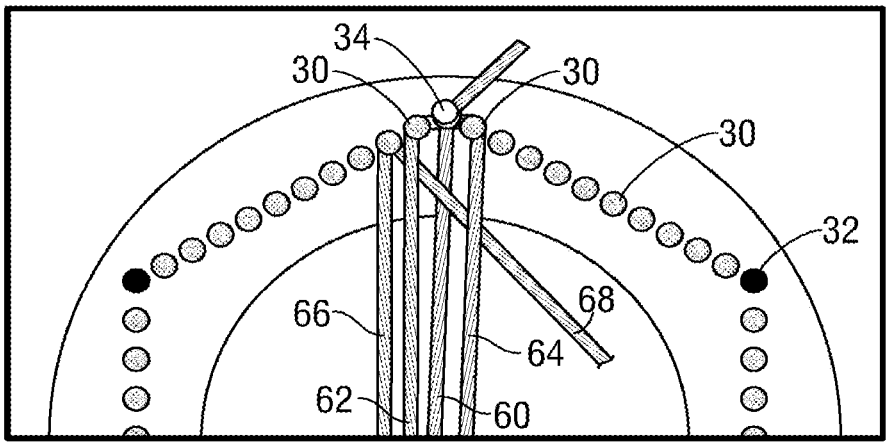
Figure 15:
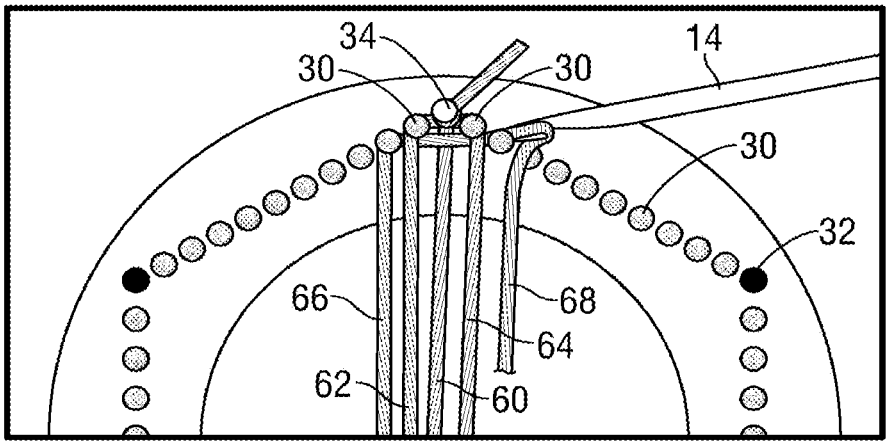

In FIG. 14 the weaver guides warp strand 66 to the next available brown pin 30 on the left at the top. Then, using crochet hook 14, the weaver guides warp strand 68 under warp strands 60 and 62. Warp strand 68 is now to go around brown pin 30. FIG. 15 is the next step in the weaving process using the crochet hook 14 going over brown pin 30.

Figure 16:
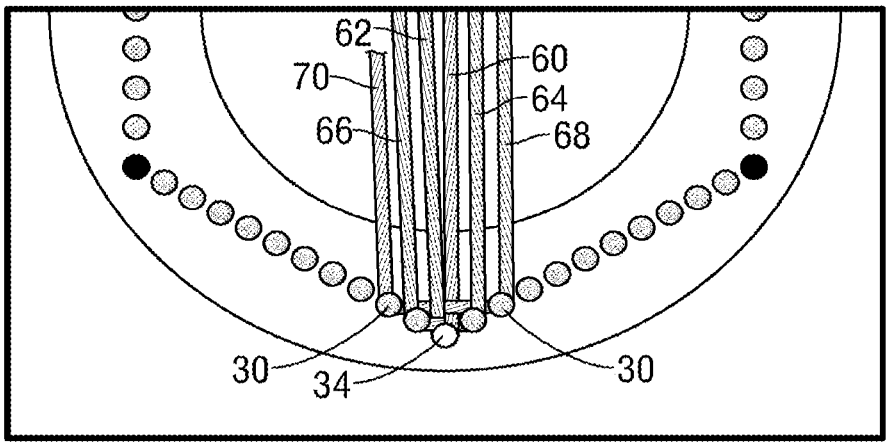

In FIG. 16, the weaver guides warp strand 68 over the next available brown pin 30 to the right of bottom white pin 34. The weaver guides with the crochet hook the working thread down to the bottom. Then the thread is placed over the next available brown pin to the right and the next available brown pin on the left. Strand 70 then continues to the next available brown pin on the top left. The weaver, thus, weaves at the top and then guides the working thread down to the bottom which automatically performs the placement in the bottom. This continues until the completion of a top triangle woven fabric section and bottom triangle woven fabric section.

At this point the horizontal yarn threads may show small arches within the weave. The arches indicate a proper tension in the woven fabric. In order to remove the arches, which is desirable for the construction of the hexagon woven fabric, packing comb 18 may be used to straighten those arched threads.

The bias weaving method continues until the black pins are covered with the yarn and the working thread comes out at the bottom left black pin.

Figure 17:
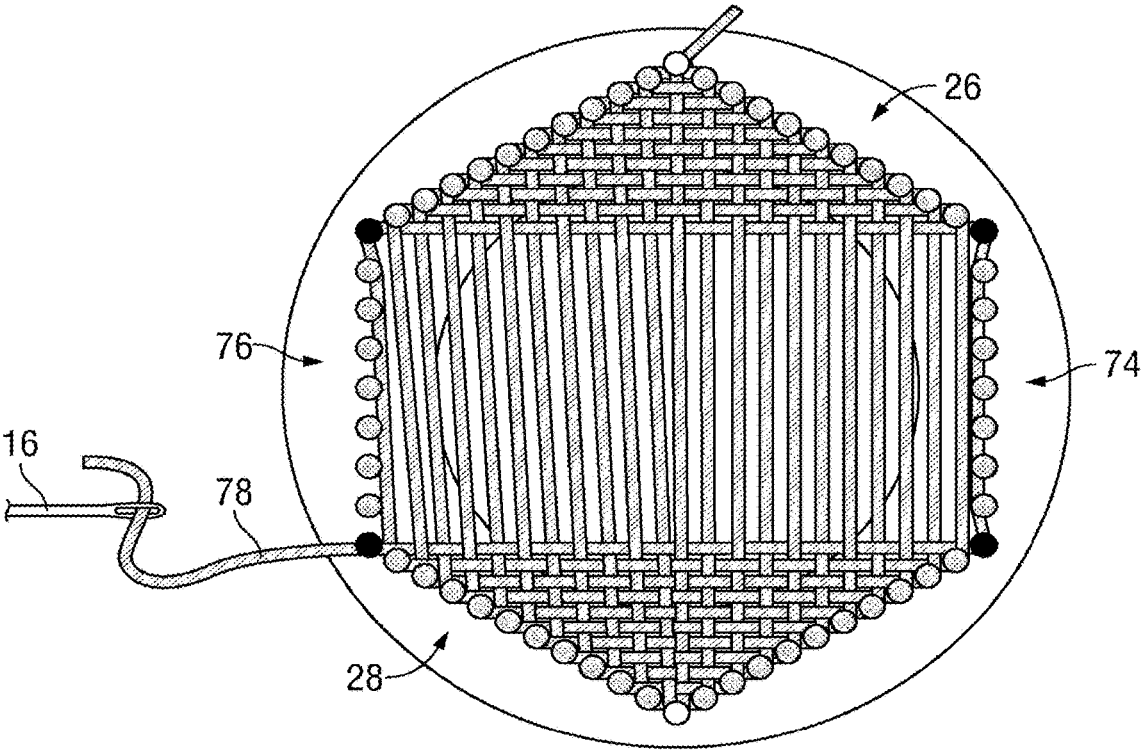
Figure 18:
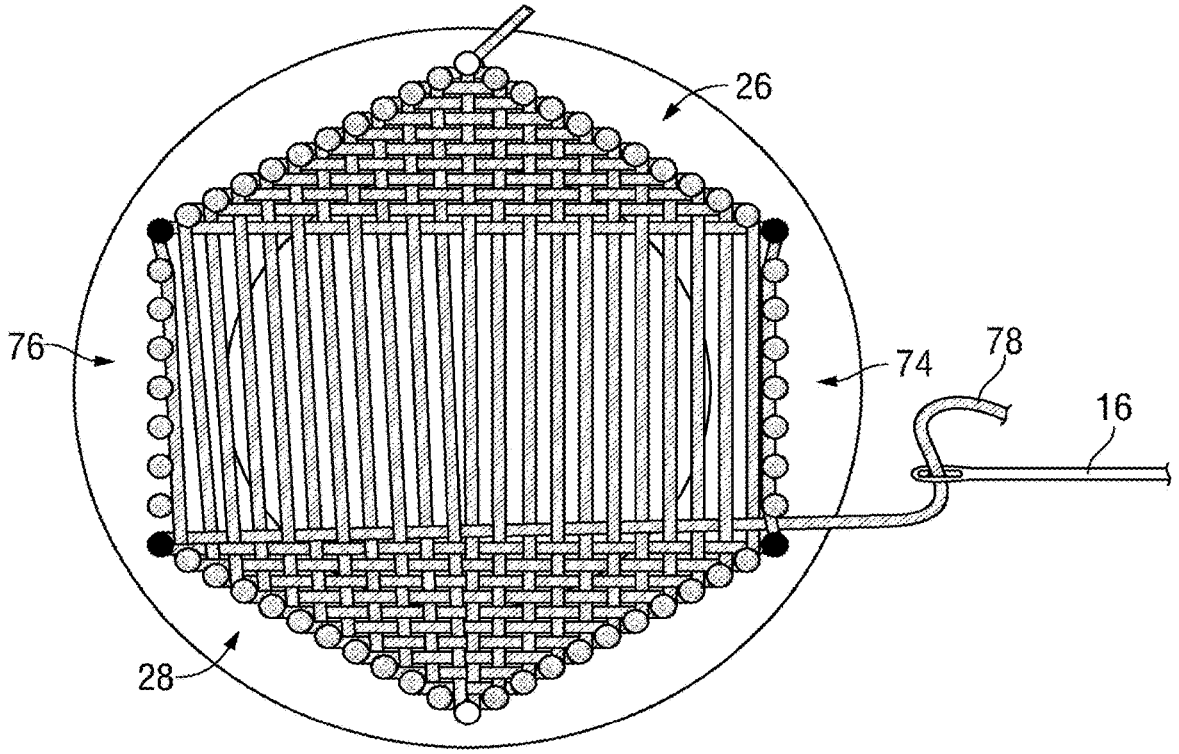

FIGS. 17 and 18 show this stage in the process. At this point, all brown pins 30 should have yarn around them at the bottom and top triangles. The yarn covers all brown pins 30 on the top and bottom size above the two black pins 32 in top angled side 26 and bottom angled side 28. This shows a triangle weave configuration at the top and the bottom portions of the woven fabric.

FIG. 17 shows that pin spacing on the side pins 74 and 76 is a little farther apart than on the top 26 and bottom 28 angled sides. For these pins there is not yet any yarn going around them. FIG. 18 shows the yarn preparation for the second part, the traditional leaving method part, of the disclosed process. For the original dimensions of the turtle loom the process includes wrapping the working yarn around the loom five times. Again, consider that a number of times around the loom that the yarn needs to be wrapped will depend on several factors. These include the thickness of the yarn, the size of the loom, and the spacing between the pins 30 in the loom 12, as well as other factors such as the elasticity of the continuous yarn strand 56. By wrapping yarn strand 56 around loom 12 hexagon forming pins, a pre-measurement of the working thread for the traditional weaving part of the disclosed process can be accurately estimated.

FIGS. 17 and 18 show the point at which the weaving method shifts from the bias method to the traditional method of weaving. And beginning the traditional weaving method, weaving needle moves back and forth over and under the vertical warp strands to complete the middle woven segment pattern while stepping up through looping around the side brown pins 74. This process fills the center section of the hexagon. Thus, in the use of the traditional method, the vertical warps that were established in the bias weaving method are now used by the horizontal weft in back-and-forth traditional weaving method. This places horizontal wefts in an escalating fashion up from the bottom triangle of the hexagon fabric to ultimately reach the top triangle.

Figure 19:
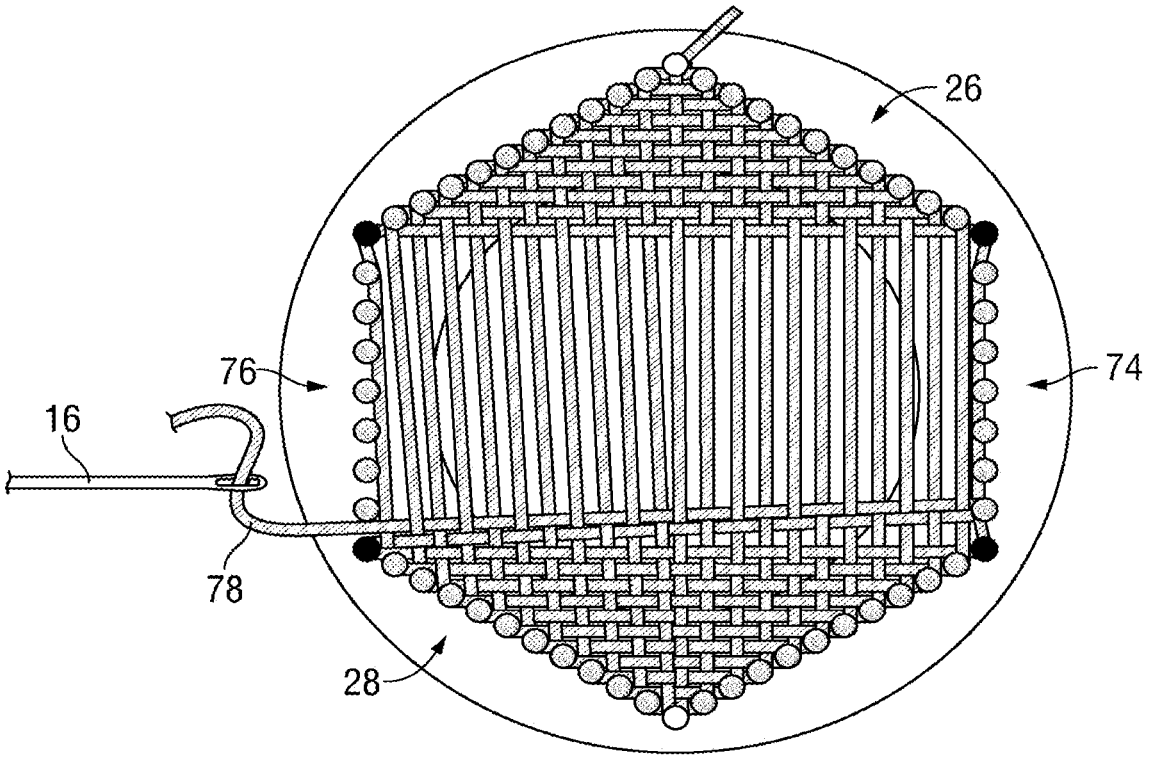
Figure 20:
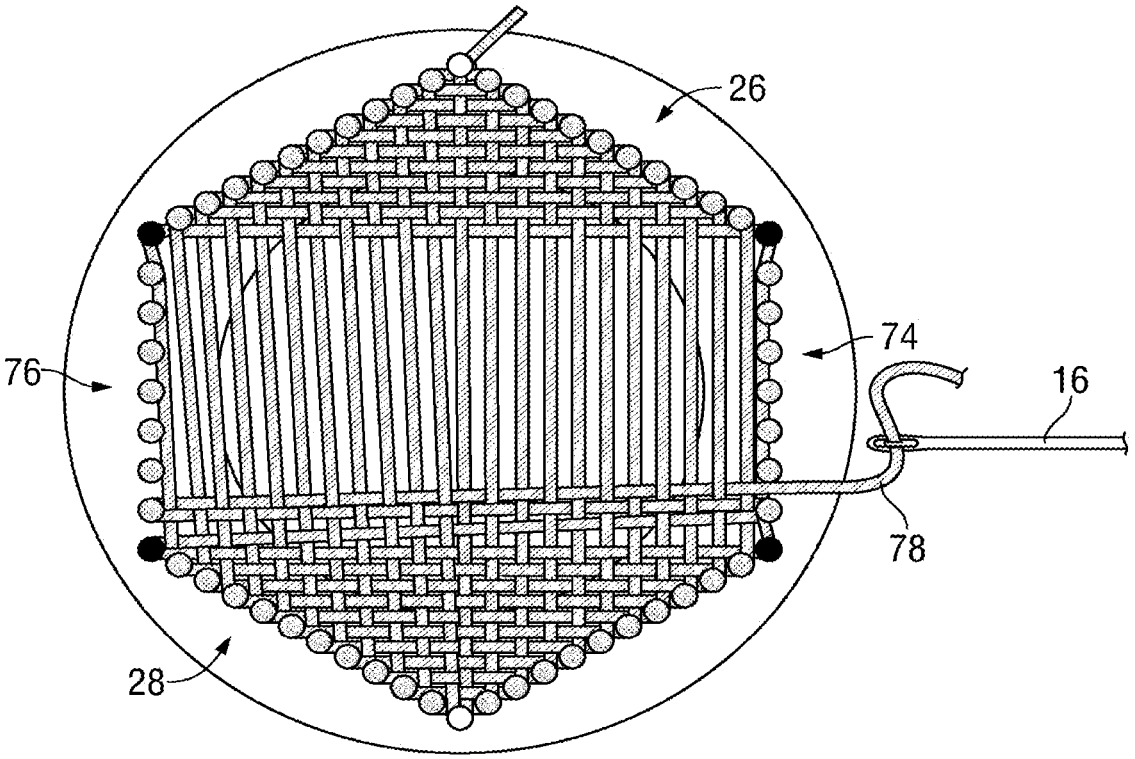
Figure 21:
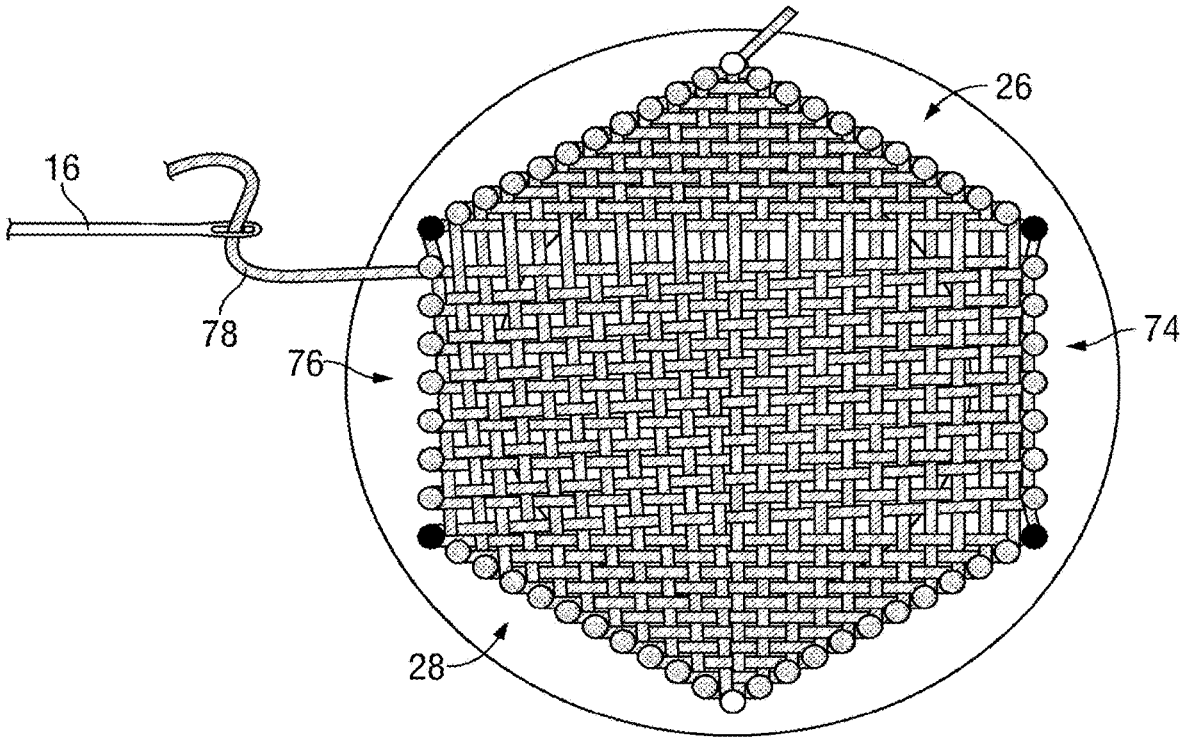
Figure 22:
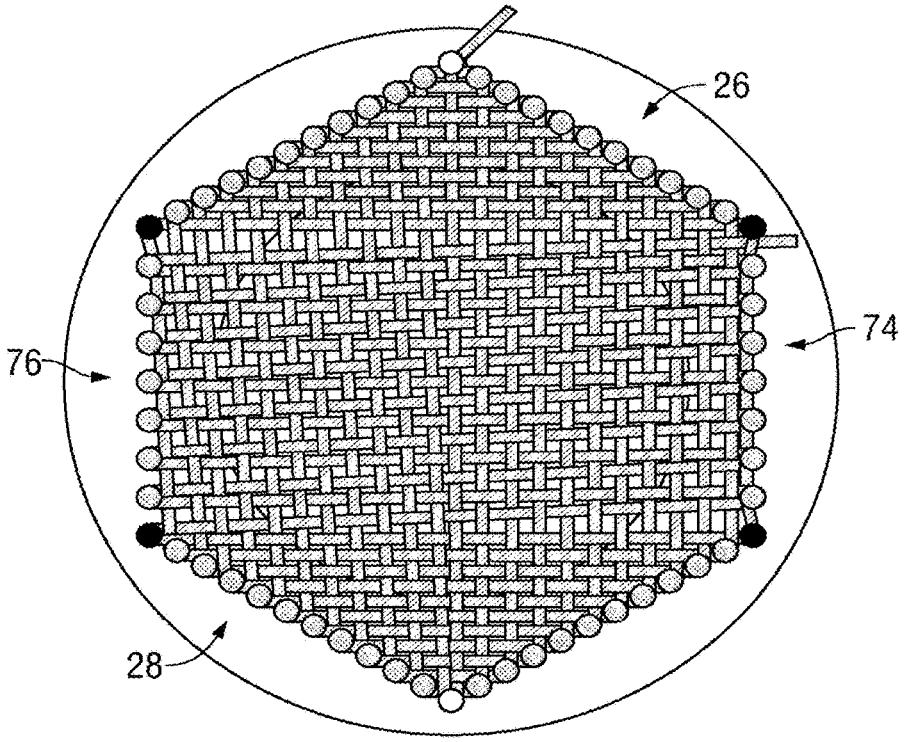

FIGS. 19 through 22 show how the traditional method fills the remaining rows in the middle section 80 of the hexagonal woven fabric. FIG. 19 shows that the weaving direction comes up from the bottom. The weaver works his way up the vertical strands to fill-in the middle section of the woven fabric. FIG. 21 is the weaving of the last row and FIG. 22 is the completed hexagon woven fabric 40.

Once the last row is woven in the middle section, the weaver can remove the hexagon woven fabric 40 from the turtle loom. To take the hexagon off the loom with color-coded headed pins, first use the weaving needle to loosen the slip knot at the starting pin. Then, using the weaving needle 16, the process entails sliding off all loops of the pins along the one side of the hexagon. After that, it is easy to lift off the rest of a hexagon with fingers. For looms 12 with headless pins, this step is simply to slide off the hexagon woven fabric 40 from loom 12.

The novel method of the present disclosure then entails pulling opposite corners and sides of the hexagon weave pattern and wiggling them a bit to even out the fabric. At that point, the hexagons are ready to be used, all ends are locked and will not unravel. For making a wide variety of items, many such hexagon weave patterns may be used.

The presently disclosed subject matter may be used easily by both right- and left-handed users. The weaving instructions are in large identical for left-handed and right-handed users. Attention is needed, however, when weaving the first part of the hexagon using the bias method.

A few simple rules pertaining to the right-handed or left-handed user apply. So, instead of "clockwise," the left-handed user will work "counterclockwise." This involves starting, as usual, at the top white pin, but when guiding the yarn to the bottom white pin, go around the pin from the "left to right," or counterclockwise. This process calls for guiding the yarn back to the top, to the first round pin on the "right" of the white pin and going around back from the right to the left, or counterclockwise. The process, then continues working counterclockwise, always working around the next available brown pin. In addition, for the left-handed weaver, at the end of the bias weaving section, the yarn will come out at the "right" bottom black pin. From there, the process includes wrapping the yarn "counterclockwise" around the hexagon to measure the length of the yarn required to weave the middle section of the hexagon.

Figure 23:
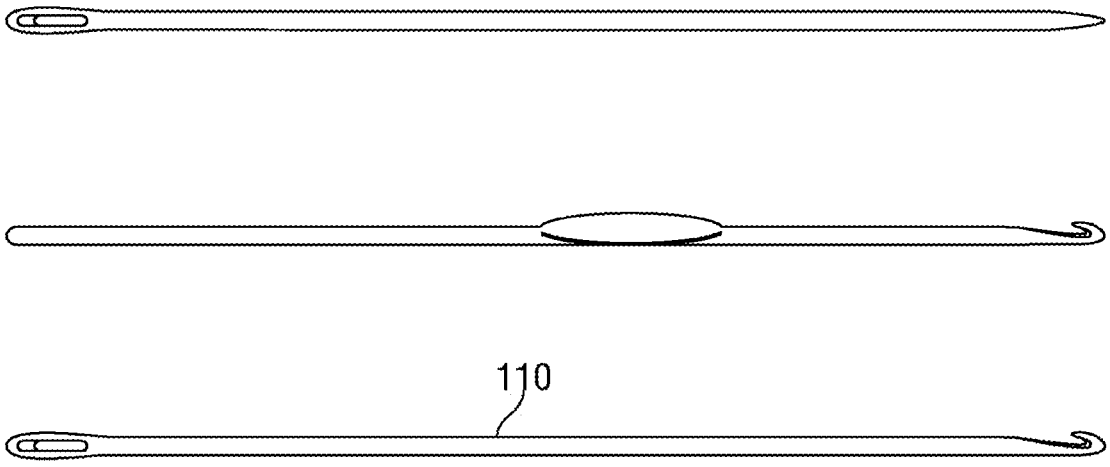
FIG. 23 illustrates alternative embodiments of weaving needles and crochet hooks for use with the presently disclosed embodiments.

FIG. 23 illustrates an alternative embodiment of the crochet hook 14 and weaving needle 16 of FIG. 1. Here, dual end locker hook 110 provides. An advantage of the locker hook is that it is a single tool that provides the functions of both the crochet book and the weaving needle. In addition, the locker hook may be preferred when particular types of yarn, for example mohair, is used because of its ability to operate more easily with these types of yarns.

Figure 24:
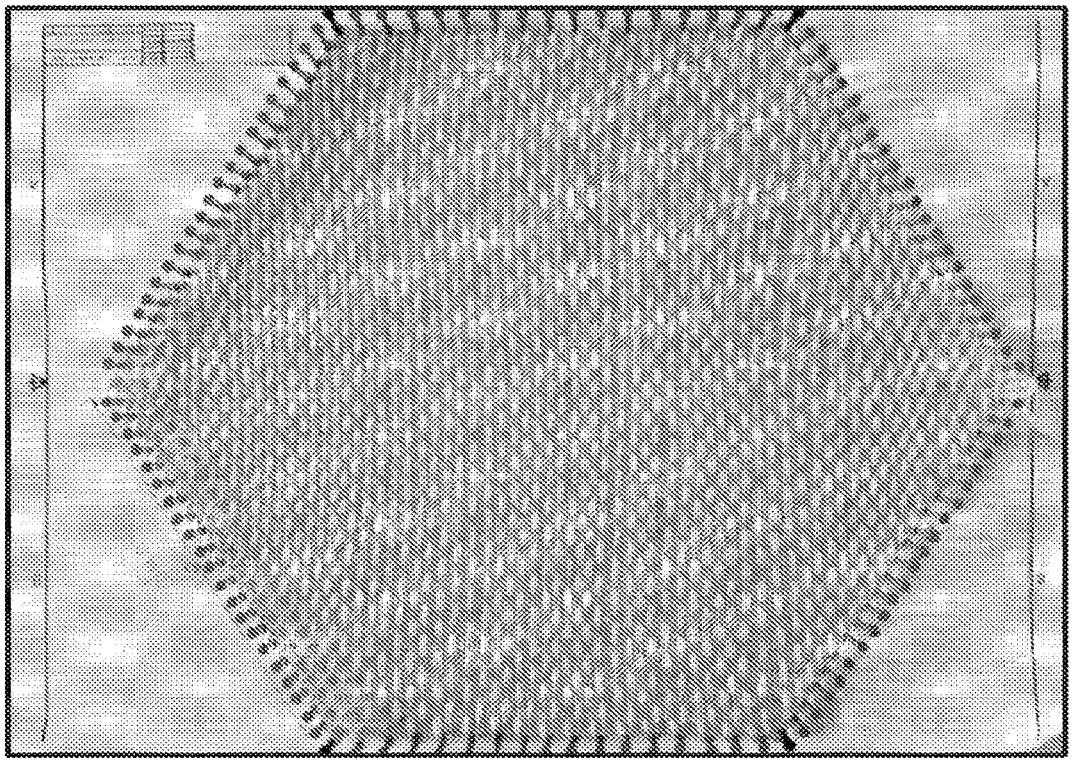
FIG. 24 shows a continuous strand hexagon woven fabric using large embodiment of the present disclosure.

FIG. 24 shows a continuous strand hexagon woven fabric 112 using large embodiment of the present disclosure.

Figure 25:
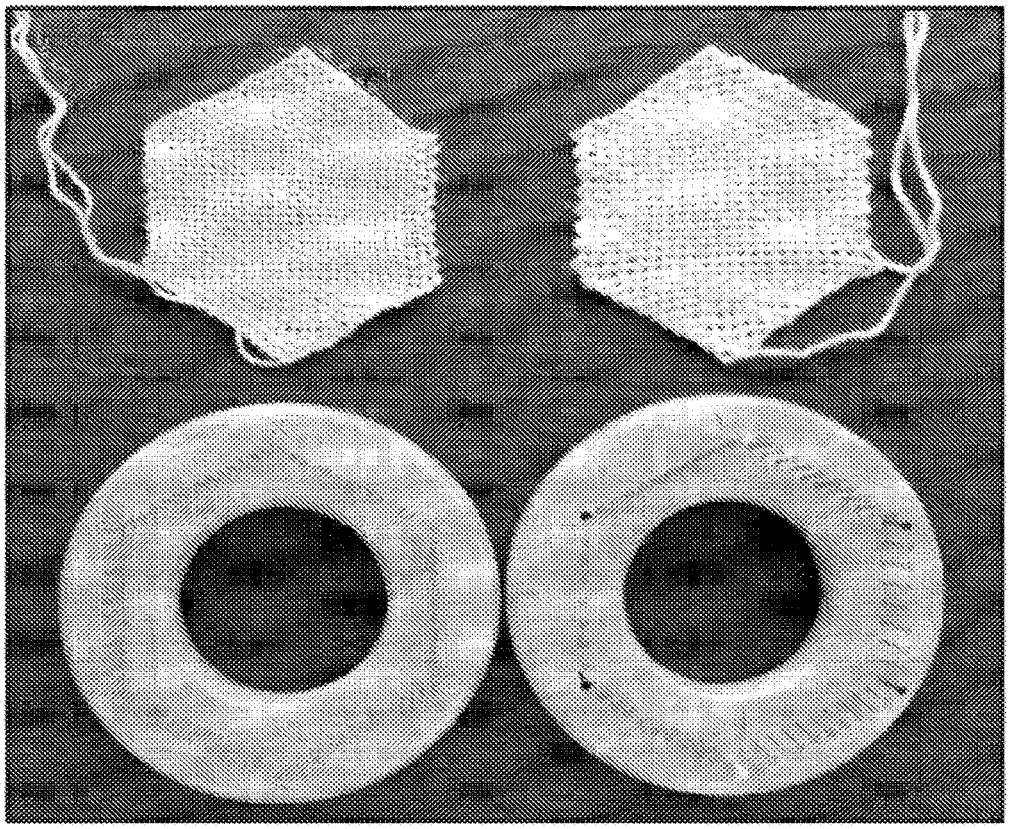
FIG. 25 shows alternative embodiments of continuous strand weaving hexagon pin looms and their differing woven fabric results.

FIG. 25 shows alternative embodiments of continuous strand weaving hexagon pin looms and their differing woven fabric results. In some embodiments, in contrast to using black, white, and brown pin colors to guide the weaving process, other ways of marking are possible. For example, the alternative loom of FIG. 25 shows the use of "hexagons" and "O"'s to identify the importance of the loom for performing the weaving process. In yet another alternative embodiment, pins without heads may be used for holding the yarn. Thus, the pins for loom 12 may have heads on them or be headless according to the desire of the user in manufacture. The headless pins also appear in FIG. 25.

Alternative embodiments of the present process include weaving additional rows when using thinner worsted weight yarns. The recommended yarn is "worsted" weight yarn, and the presently disclosed loom has successfully woven a large variety of materials, including acrylics, blends, cotton, wool, rayon, silk . . . materials that are fuzzy, shiny, nubby, marled, store-bought, even hand spun. The best way to determine whether a yarn will work is to weave a sample hexagon.

However, even with the "worsted" category, some yarns are better than others. If the user works with a "thinner" worsted weight yarn and notices that the fabric weaves is just a little bit too loosely, the user can easily weave two or any multiple of two extra rows in the middle section of the hexagon to improve the density of the fabric.

There are many choices in yarns that a weaver may use to practice the presently disclose subject matter. Every yarn is not perfect for every project. So, properly selecting a yarn weights will allow significantly more creativity in choices of the appropriate yarn. The standard yarn weight system provides yarn weights by referring to the thickness of the yarn.

Yarn thicknesses may range from super fine to super bulky. Seven different standard categories of yarn weights, established by the Craft Yarn Council, assign specific weights of yarn according to how a yarn produces a somewhat predictable number of stitches when using a particular sized needle. The higher the number, the heavier the yarn and the fewer stitches per inch the weaver will get but ply doesn't always correlate to the weight of a yarn.

Standards matter because, if the weaver knows that every bulky yarn is going to give around the same number of stitches (e.g., 12 to 15 stitches in four inches on size 9 to 11 needles) and he uses a pattern with bulky yarn and size 10 needles, he can use any kind of bulky yarn and get a similar result.

Most yarn manufacturers make it easy to determine the weight of a particular yarn. Many mass-produced yarns use the yarn standards ranking system and will have the number and weight printed right on the label. Other manufacturers don't make it as easy but will say something like "24 stitches and 22 rows per four inches on size 4 needles."

In various embodiments of the present disclosure, uses may include weight 1-2 for "fine sett," 4 for the original pin spacing, and 5-6 for the "bulky sett." Weight 3 can be accommodated by weaving extra rows and/or starting with a loop instead of a single string, as described above.

Figure 26:
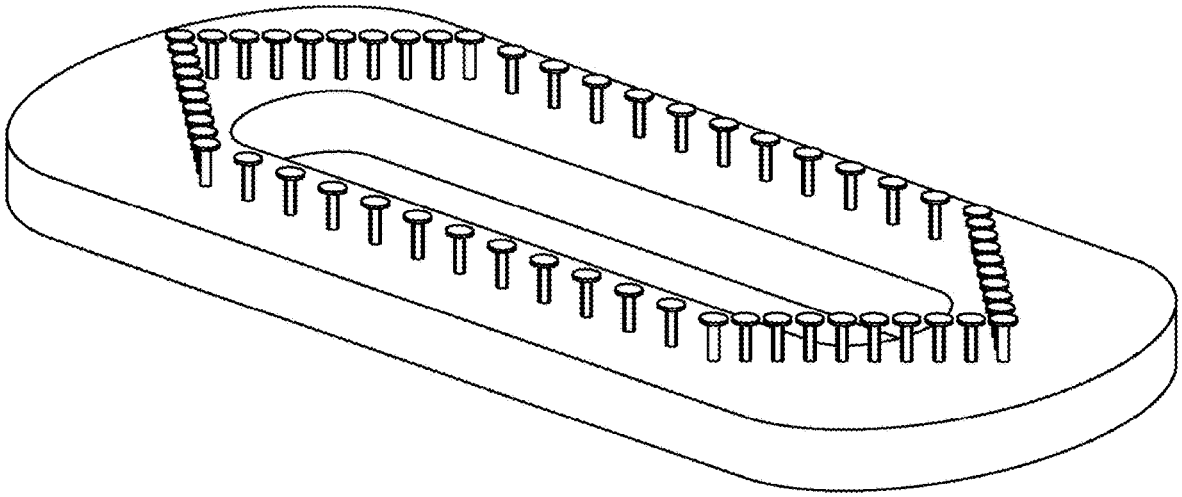
FIG. 26 illustrates an elongated continuous strand weaving pin loom within the scope of the present disclosure.
Figure 27:
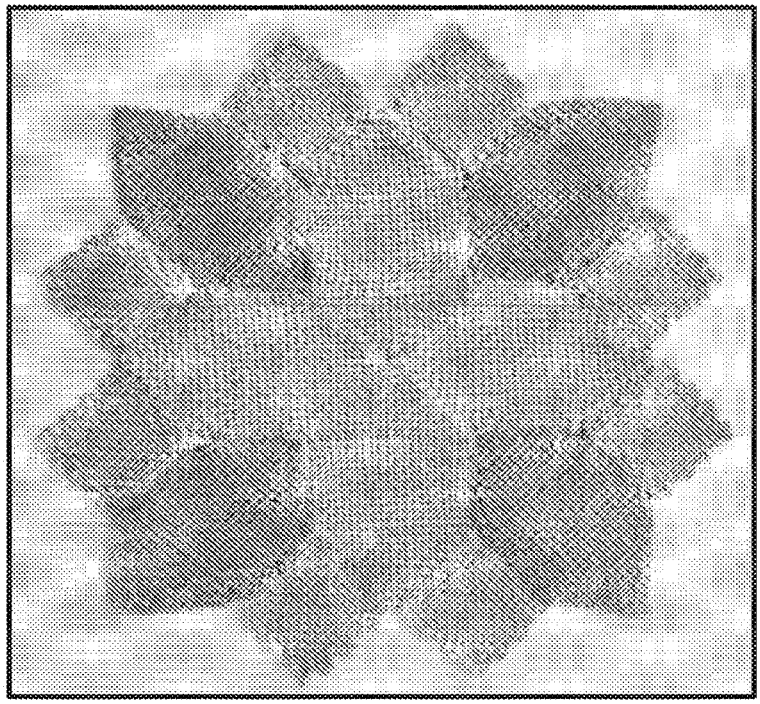
FIGS. 27 through 32 show various attractive items that may be formed using the presently disclosed continuous strand weaving pin loom.
Figure 28:
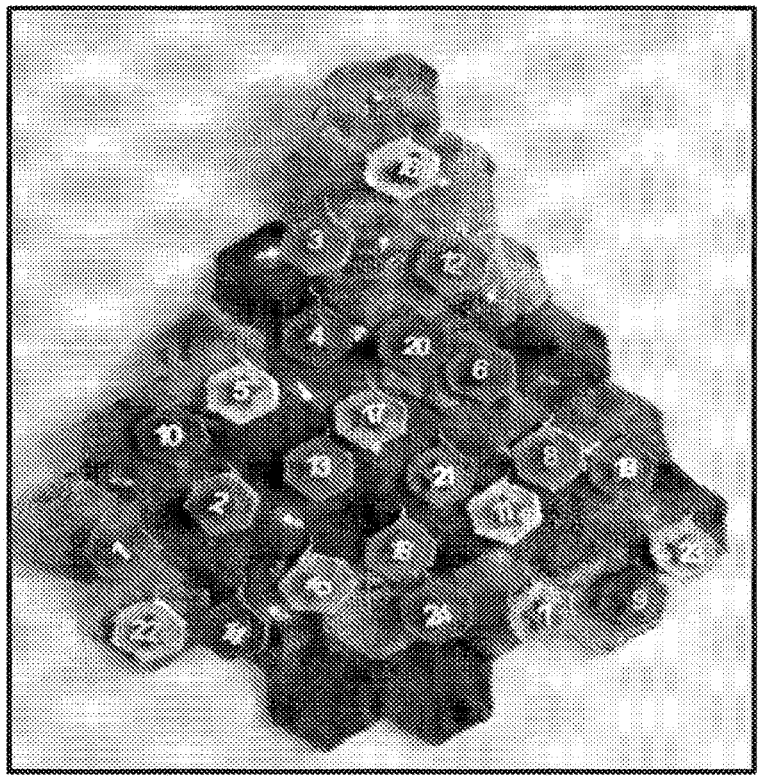
Figure 29:
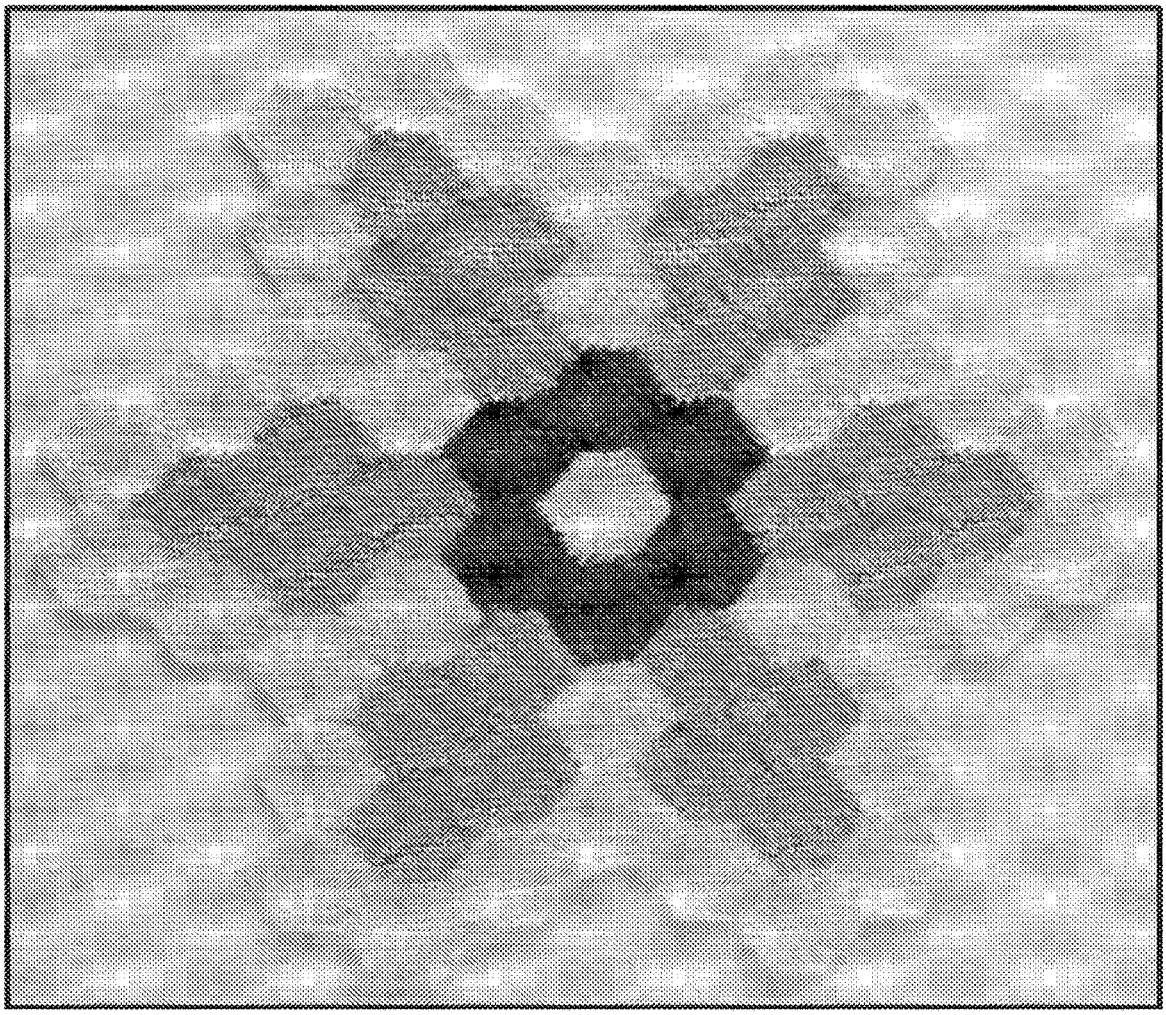
Figure 30:
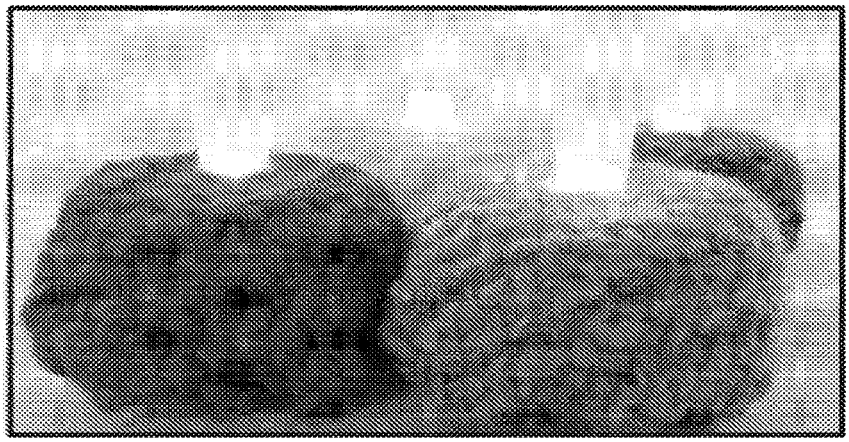
Figure 32:
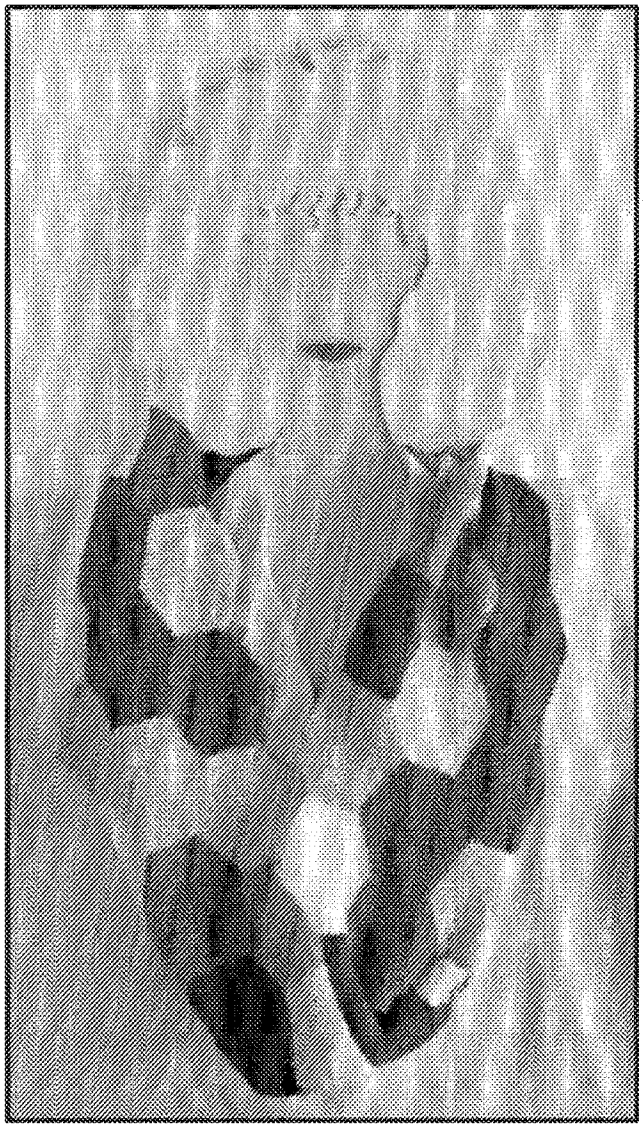
Figure 31:
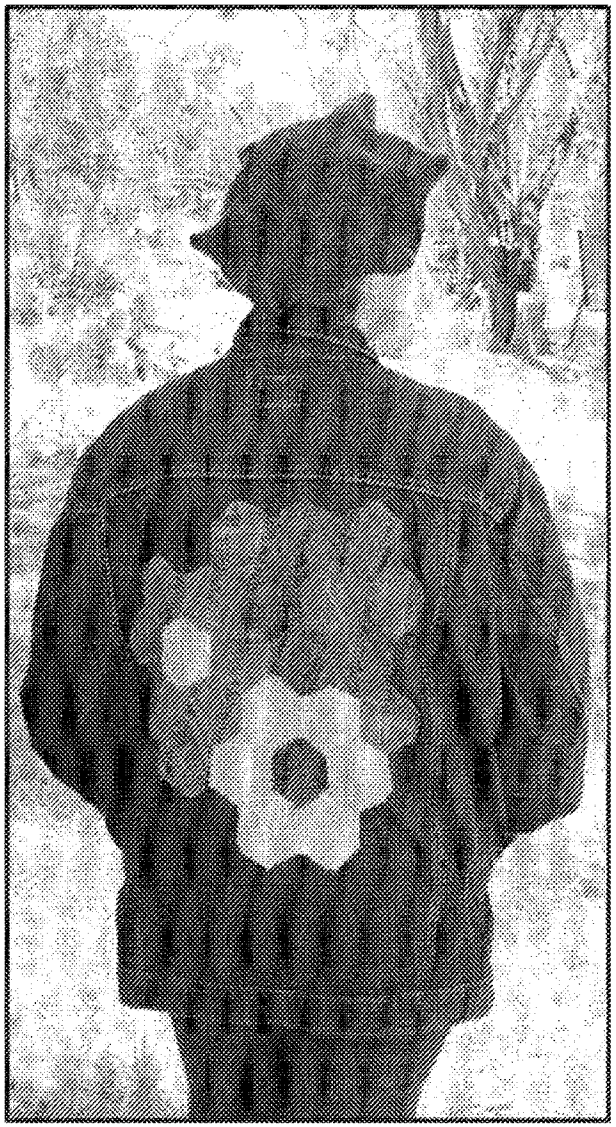

FIG. 26 illustrates an elongated continuous strand weaving pin loom within the scope of the present disclosure; and FIGS. 27 through 32 show various attractive items that may be formed using the presently disclosed continuous strand weaving pin loom.

The foregoing description of embodiments is provided to enable any person skilled in the art to make and use the subject matter. Various modifications to these embodiments will be readily apparent to those skilled in the art, and the novel principles and subject matter disclosed herein may be applied to other embodiments without the use of the innovative faculty. The claimed subject matter set forth in the claims is not intended to be limited to the embodiments shown herein, but is to be accorded the widest scope consistent with the principles and novel features disclosed herein. It is contemplated that additional embodiments are within the spirit and true scope of the disclosed subject matter.

The benefits and advantages that may be provided by the present invention has been described above regarding specific embodiments. These benefits and advantages, and any elements or limitations that may cause them to occur or to become more pronounced are not to be construed as critical, required, or essential features of any of any or all of the claims. As used herein, the singular forms "a", "an", and "the" are intended to include the plural forms as well, unless the context clearly indicates otherwise. It is further understood that the terms "comprises" and/or "comprising" or "includes" and/or including", or any other variation thereof, are intended to be interpreted as nonexclusively including the elements or limitations which follow those terms. Accordingly, a system, method, or other embodiment that comprises a set of elements is not limited to only those elements, and may include other elements not expressly listed or inherent to the claimed embodiment. These terms when used in this specification, specify the presence of stated features, regions, integers, steps, operations, elements, and/or components, but do not preclude the presence or addition of one or more features, regions, integers, steps, operations, elements, components, and/or groups thereof.

I claim:

1. A method for forming a hexagonal woven fabric, the method comprising the steps of:

providing a single continuous yarn strand for forming said hexagonal woven fabric;

providing a hexagonal pattern loom comprising:

a loom frame;

a plurality of loom pins perpendicularly embedded into said loom frame and protruding predetermined distance for engaging and holding the single continuous yarn strand;

said plurality of loom pins arranged in a hexagonal pattern to form a structure for engaging said single continuous yarn strand;

a first predetermined subset of said loom pins form a top angled side of said hexagonal pattern;

a second predetermined subset of said loom pins form a bottom angled side of said hexagonal pattern; and a third predetermined subset of said loom pins form two opposite straight sides of said hexagonal pattern, said two opposite straight sides connecting to said top angled side and said bottom angled side to form the loom pins spacing for said hexagonal pattern loom;

bias weaving using the continuous yarn strand for forming a top woven triangle fabric section, a bottom woven triangle fabric section, and a middle section of parallel yarn strand portions of the single continuous yarn strand, said middle section forming a plurality of weaving warps for continuing to weave using the single continuous yarn strand;

traditional back-and-forth weaving using said single continuous yarn strand as weft strands in said middle section of parallel yarn strand portions for forming a rectangular woven fabric section, wherein upon completing said back-and-forth weaving step said top woven triangle fabric section, said bottom woven triangle fabric section, and said rectangular woven fabric section form a hexagonal woven fabric using the single continuous yarn strand; and separating said hexagonal woven fabric segment from said hexagonal pattern loom.

2. The method of claim 1, wherein said loom pins forming said two opposite straight sides connecting to said top angled side and said bottom angled side comprising spacing for resulting in evenly distributed woven pattern across the entirety of said hexagonal loom pattern.

3. The method of claim 1, further comprising a step of beginning said bias weaving step by tying said single continuous yarn strand to a predetermined top loom pin.

4. The method of claim 3, further comprising a step of continuing said bias weaving step from said predetermined top loom pin until said single continuous yarn strand reaches said loom pins joining said top angled side, said opposite straight sides, and said bottom angled side.

5. The method of claim 1, wherein each of said two opposite sides of said hexagonal loom pattern comprises a length essentially equal to each of two sides of said top angled side and said bottom angled side of said hexagonal loom pattern, and further performing said bias weaving step and said traditional back-and-forth weaving step to yield a symmetric hexagonal woven fabric.

6. A method for forming a craft item using a plurality of interconnected hexagonal woven fabric segments, one hexagonal woven fabric segment of said plurality of interconnected hexagonal woven fabric segments is formed by performing the steps of:

providing a single continuous yarn strand for forming said hexagonal woven fabric segment;

providing a hexagonal pattern loom comprising:

a loom frame;

a plurality of loom pins perpendicularly embedded into said loom frame and protruding predetermined distance for engaging and holding the single continuous yarn strand;

said loom pins arranged in a hexagonal pattern to form a structure for engaging said single continuous yarn strand;

a first predetermined subset of said loom pins form a top angled side of said hexagonal pattern;

a second predetermined subset of said loom pins form a bottom angled side of said hexagonal pattern; and a third predetermined subset of said loom pins form two opposite straight sides of said hexagonal pattern, said two opposite straight sides connecting to said top angled side and said bottom angled side to form the pin spacing for said hexagonal pattern loom;

bias weaving using the single continuous yarn strand for forming a top woven triangle fabric section, a bottom woven triangle fabric section, and a middle section of parallel yarn strand portions of the single continuous yarn strand, said middle section forming a plurality of weaving warps for continuing to weave using the single continuous yarn strand;

traditional back-and-forth weaving using said single continuous yarn strand as weft strands in said middle section of parallel yarn strand portions for forming a rectangular woven fabric section;

wherein upon completing said back-and-forth weaving step said top woven triangle fabric section, bottom woven triangle fabric section, and said rectangular woven fabric section form a hexagonal woven fabric using the single continuous yarn strand; and forming said craft item by placing said plurality of interconnected hexagonal woven fabric segments adjacent to each other.

* * * * *